US005199931A

United States Patent [19]

Easley et al.

[11] Patent Number: 5,199,931

[45] Date of Patent: Apr. 6, 1993

[54] EXERCISE MACHINE FOR SIMULATING STAIR CLIMBING

[75] Inventors: James B. Easley, Minneapolis; A. Hans Friedebach; Mark R. Nestande, both of Chaska; Paul M. Theisen, Shakopee; John E. Titus, Savage, all of Minn.

[73] Assignee: Fitness Master, Inc., Waconia, Minn.

[21] Appl. No.: 800,554

[22] Filed: Nov. 27, 1991

[51] Int. Cl.[5] ..... A63B 22/04

[52] U.S. Cl. ..... 482/52; 482/110

[58] Field of Search ..... 482/52, 110, 111, 53, 482/51, 57, 63

[56] References Cited

U.S. PATENT DOCUMENTS

| | | | |
|---|---|---|---|
| D. 302,451 | 7/1989 | Bull et al. . | |
| D. 304,358 | 10/1989 | Armstrong et al. . | |
| D. 321,229 | 10/1991 | Dalton et al. . | |
| D. 324,089 | 2/1992 | Miller . | |
| 3,497,215 | 2/1970 | Harrison et al. . | |
| 3,743,283 | 7/1973 | Garrett . | |
| 3,970,302 | 7/1976 | McFee . | |
| 4,340,218 | 7/1982 | Wilkinson . | |
| 4,496,147 | 1/1985 | DeCloux et al. . | |
| 4,555,108 | 11/1985 | Monteiro . | |
| 4,687,195 | 8/1987 | Potts . | |
| 4,708,338 | 11/1987 | Potts | 482/52 |
| 4,726,581 | 2/1988 | Chang . | |
| 4,830,362 | 5/1989 | Bull . | |
| 4,838,543 | 6/1989 | Armstrong et al. . | |
| 4,909,504 | 3/1990 | Yang . | |
| 4,934,688 | 6/1990 | Lo | 482/111 |
| 4,934,690 | 6/1990 | Bull . | |
| 4,938,474 | 7/1990 | Sweeney et al. . | |
| 4,949,993 | 8/1990 | Stark et al. | 482/52 |
| 4,989,858 | 2/1991 | Young et al. . | |
| 5,000,441 | 3/1991 | Wang . | |
| 5,000,443 | 3/1991 | Dalebout et al. . | |
| 5,004,224 | 4/1991 | Wang . | |
| 5,013,031 | 5/1991 | Bull . | |
| 5,033,733 | 7/1991 | Findlay | 482/52 |
| 5,039,087 | 8/1991 | Kuo . | |
| 5,048,821 | 9/1991 | Kuo-Liang . | |
| 5,054,770 | 10/1991 | Bull . | |
| 5,078,390 | 1/1992 | Hurt . | |

*Primary Examiner*—Stephen R. Crow
*Attorney, Agent, or Firm*—Dorsey & Whitney

[57] ABSTRACT

The present invention is an improved exercise machine for simulating stair climbing, particularly adapted for in-home use. The device includes a generally upright frame with a base. Right and left foot pedals are pivotally mounted to the base on either side of the upstanding portion of the frame and a handlebar is provided adjacent the upper end of the frame. The foot pedals are linked to a mechanical resistance element, namely a flywheel. The linkage includes a strap connecting each pedal to a single drive shaft, in turn connected by a belt transmission to the flywheel. A resistance adjustment feature is included in the invention.

18 Claims, 4 Drawing Sheets

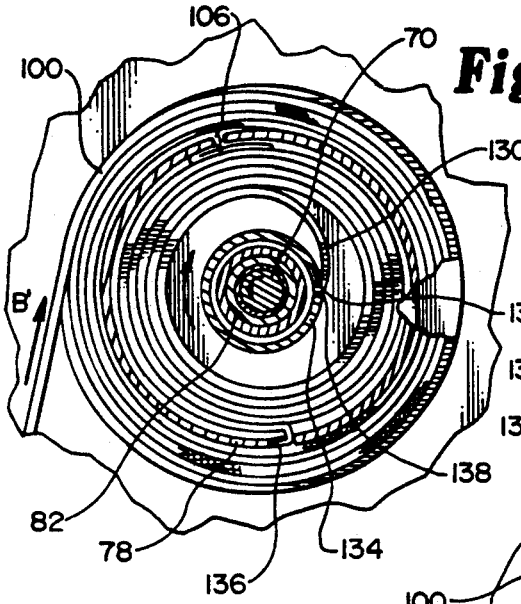
Fig. 3
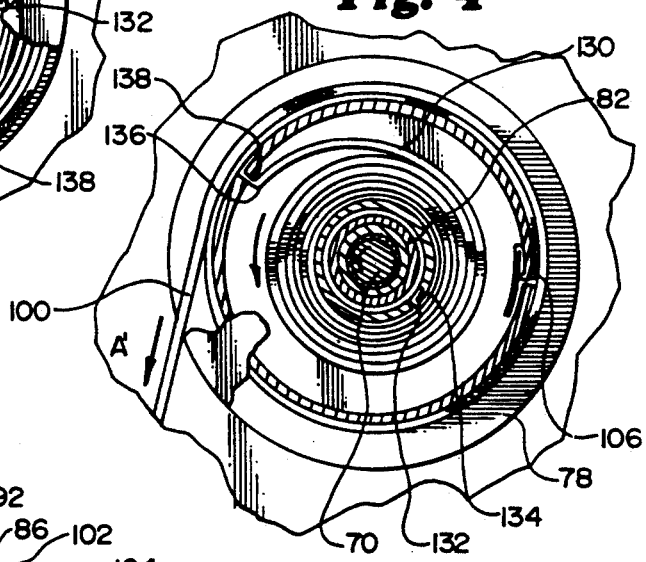
Fig. 4
Fig. 6
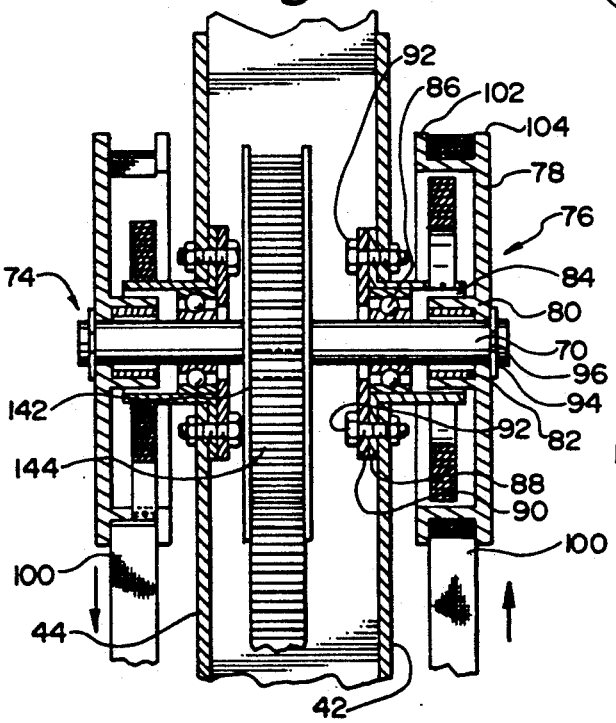
Fig. 5
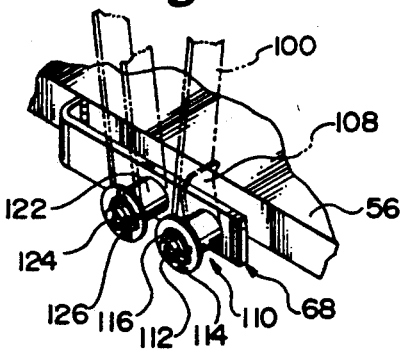

EXERCISE MACHINE FOR SIMULATING STAIR CLIMBING

TECHNICAL FIELD

This invention relates to exercise devices. More particularly, it relates to a mechanical exercise machine that biomechanically simulates climbing stairs to provide exercise for the user.

BACKGROUND OF THE INVENTION

Many types of exercise equipment and devices are currently in use to provide exercise for persons who want to stay physically fit and for persons with special physical or therapeutic needs. The stationary exercise bicycle is one of the best known of such exercise devices. Other types of equipment include various forms of treadmills, frame-like weight lifting stations, including pivotable or swingable components, and, more recently, exercise devices that simulate climbing stairs.

A person going up stairs does work, and burns calories, by raising the body's weight. Stair climbing exercise devices attempt to simulate the biomechanical activity and effect of climbing steps. In stair climbing devices, the exerciser's work typically is done by maintaining the body in the same place while the steps move, that is, by shifting body weight repeatedly from one foot to the other, optionally against variable resistance. The user's feet generally are received on moving or movable foot receiving members. Separate foot receiving members are common, either moving continuously in one direction or between an upper position and a lower position alternatively. In the latter, as one foot of the user presses down on a foot-receiving member in its upper position, that member is driven down against resistance. Generally, the second member will be rising at the same time. When the second member reaches its upper position, the user presses down on it with the other foot, raising the weight of the body, and driving the second member down.

Representative examples of fairly early stair climbing devices include those disclosed in U.S. Pat. Nos. 3,497,215 (to Harrison), 3,743,283 (to Garrett), 4,340,218 (to Wilkinson), 4,687,195 (to Potts), 4,555,108 (to Monterio), and 4,726,581 (to Chang). These patents reflect the development of stair simulators, disclosing substantially static steps (the Garrett and Wilkinson patents) or an escalator-like plurality of moving steps connected to endless chains (the Harrison, Chang and Potts patents). The patent to Monterio discloses two sets of circumferential steps mounted on a rotatable member.

Some stair devices, such as those disclosed in U.S. Pat. Nos. 3,970,302 (to McFee) and 4,496,147 (to DeCloux et al.), include a pair of reciprocally movable foot receiving supports carried by inclined track members. In use, the user steps on one foot support while removing weight from the second. The foot support without weight rises, while the support bearing weight descends at a rate determined by the resistance. When the downwardly traveling support reaches the end of travel, the user transfers his weight to the other foot and the motion of the supports reverses. The McFee and DeCloux et al. patents also disclose resistance systems, including shock absorbers or hydraulic systems, used in this type of device, and in stair simulators generally.

While the above prior art devices are useful, some of them are rather large for in-home use, they may not provide optimally comfortable aerobic exercise workouts, they require reciprocal leg motion, and they may be quite noisy.

U.S. Pat. No. 4,708,338 (to Potts) is directed to solving at least some of these problems by providing a stair climbing exercise apparatus, including a frame with a base and a plate attached to the base. A right and left pedal, on opposite sides of the plate, alternatively and independently oscillate between an upper rest position and a lower position attained by the weight of or force generated by the user. Each pedal is returned to its upper position by a spring. As the pedals travel downwardly, they drive a drive sprocket in one direction through right and left sprockets, including free-wheeling, one way clutches. Each sprocket is driven by a chain connected to the associated pedal at one end and to the return coil spring at the other end. A single continuous chain drivingly connects the drive sprocket and a transmission, in turn joined to an alternator that acts as a dynamic brake for providing resistance.

Somewhat similarly, the device disclosed in U.S. Pat. No. 4,938,474 (to Sweeney et al.) includes two pedals and two spring-biased chain and sprocket arrangements, one such arrangement associated with each pedal. The sprockets are mounted on one-way roller clutches so that as each pedal moves downwardly, the drive shaft is rotated only in one direction. A drive sprocket is secured to the drive shaft and drives a single endless chain, in turn connected to another sprocket mounted on a shaft on which a flywheel is mounted. The primary aspect of the Sweeney et al. apparatus is an automatic speed control system including a micro-controller.

U.S. Pat. No. 4,949,993 (to Stark et al.) is directed to solving problems associated with the roller chain and sprocket arrangements used in stair devices like those disclosed in U.S. Pat. Nos. 4,708,338 and 4,938,474 (to Potts and Sweeney et al., respectively). More specifically, the problem addressed by the Stark et al. patent is that the chains commonly used to connect the pedals to the one-way drive shaft tend to break. The Stark et al. solution is to provide a cable or "wire rope" and pulley wheel as the first portion of the force transmitting system. Two cables and one pulley are operably connected to each pedal, the first cable with one end secured to the pedal arm and the second end secured to the pulley, and the second cable with one end secured to the same pulley and the other end secured to a lengthy tension spring. As one cable moves the pulley by unwinding, the other winds into a groove on the pulley.

The Stark et al. device requires a large diameter sprocket wheel to maintain the speed relationship between the pedal motion and the flywheel motion. This is because the pulley wheels that receive the cables must have a larger working diameter to enable the required cable wrapping without undue lateral stresses being created in the cable. A problem only partially solved by the Stark et al. teachings is that in sprocket and roller chain arrangements, each sprocket tooth to chain engagement creates a feel of roughness. While the Stark et al. patent teaches that the chains connected to the pedal arms may be replaced by cables, a sprocket wheel and roller chain arrangement is still required. Additionally, a high spring force is required to maintain the pedal in contact with the user's foot, to prevent slack in the cables, and to compensate for cable stretch.

U.S. Pat. No. 5,033,733 (to Findlay) discloses another stair climbing exercise apparatus. The apparatus includes the typical arrangement of two side-by-side steps mounted on bars pivotally connected to a frame. A cable or strap connects each step to a spring-driven pulley. The pulleys are connected via a bushing and a one-way clutch to a drive shaft. The clutch is engaged only upon downward motion of the associated step to drive the shaft in one direction. The shaft in turn drives a multiple planetary gear arrangement, the output of which drives a rotary member having an electro-magnetic resistance element. With all the adjacent movable mechanical parts associated with the multiple planetary gear arrangement, the Findlay apparatus does not reduce lash to a minimum.

While the above-cited prior art generally reflects progressive improvement in stair climbing simulators, and the latter two patents (to Findlay and Stark et al.) solve some of the problems associated with prior art exercising devices, it is clear that with current stair devices smoothness, fluidity, safety and quietness are not optimized. There is a need for a reasonably priced, biomechanically and ergonomically sound stair climbing simulator or "stepper" exercise machine that the exerciser enjoys using because the machine is attractive, quiet, self-prompting and has a smooth, fluid motion.

SUMMARY OF THE INVENTION

In accordance with the present invention, an improved stair climbing exercise machine is provided. The machine biomechanically simulates climbing stairs to provide exercise for a user and broadly comprises a frame, right and left foot receiving pedals, a mechanical resistance element, and a drive system operatively coupling the pedals to the resistance element.

The frame is formed of generally tubular frame members and includes a base and an upright mast. A pair of plates, a right plate and a left plate, is connected to the base and mast. A handlebar arrangement is mounted adjacent the upper end of the mast.

The independently operable right and left pedals are pivotally connected to the base on respective sides of the mast. The drive system connects the pedals to the resistance element, broadly transmitting the force exerted by the user upon the pedals to the resistance element. The drive system includes a first portion linking each pedal to a single rotatable drive shaft and a second portion that transmits the rotation of the drive shaft to the resistance element, a flywheel.

An object of the present invention is to provide a stair climbing simulator that is safe, inexpensive and provides excellent aerobic exercise for a user.

Other objects of the present invention are to provide an exercise device that is small and compact enough to be used conveniently in a home without wasting valuable storage or living space, and to provide a device that may be purchased for home use at a reasonable cost.

Yet another object of the present invention is to provide a stair climbing simulating exercise device that a user will enjoy using.

A feature of the exercise machine of the present invention is a drive system that maximizes a smooth and fluid motion by incorporating a first drive portion, comprising two independent parallel drive linkages, a right drive linkage and a left drive linkage, linking each pedal to a single rotatable drive shaft. Each drive linkage includes a web or strap having two ends, a first end connected to the associated pedal arm and a second end connected to a reel-like, recoil spool with a hub operably mounted on a one-way clutch. Each clutch and spool assembly is mounted on the drive shaft. In both the right and left drive linkages the strap passes over at least one independent idler sheave between its two ends. A concentric, flat, clock-wound return spring is inside each spool and is operably connected to the hub of the spool.

Yet another feature of the drive system of the present invention that maximizes smooth and fluid motion is a second drive portion that transmits the rotation of the drive shaft on which the two spools are mounted to an inertial resistance element or flywheel mounted between the right and left plates. In the second drive portion, a first primary drive sheave is mounted on the drive shaft and connected to an intermediate transfer sheave by an endless power belt. The intermediate drive sheave is connected to a final sheave by a second power drive belt. The final sheave is secured to the axle on which the flywheel is mounted. At least a pair of tension adjustment members is provided for adjusting the tension of the first and second power belts connecting the drive shaft to the flywheel.

Another feature of the present invention is an exercise effort level adjusting mechanism that mechanically brakes the flywheel. The adjustment mechanism includes a brake band which contacts the outer diameter of the flywheel and which may be adjusted to contact a larger portion of the outer diameter with more or less force, thereby increasing or diminishing the amount of effort required to spin the flywheel.

Other features include a mechanical, electro-optical, or electro-mechanical counter for counting the number of strokes of one or both pedals, non-skid foot receiving surfaces on each pedal, and a handlebar adapted to be used comfortably in more than one exercising position. The drive system of the machine of the present invention may be covered by an attractive shroud or housing cover.

In use, the user grasps the handlebar and places respective feet on the pedals which will be in an uppermost rest position by virtue of the clock-wound return springs. The weight of the user will cause one or both pedals to sink to their lowermost position. The user may adjust the resistance and begin exercising by transferring weight from one foot to the other.

Because the pedals are independently operable, the user can select a comfortable length for the stepping or stair climbing stride. The machine has a direct mechanical interlink between the user and the resistance element; there is no need to program a controller or make complicated adjustments to a speed governor or electronic control system.

When the user has received a sufficient work out, the weight transfer from foot to foot is stopped and both pedals will move downwardly to their lowermost position under the weight of the user, who may then simply step off. The clock-wound return springs will gently return the pedals to their uppermost position and the machine is ready for the next user.

One of the important advantages of the present invention is that it improves the smoothness and fluidity of the exercise motion, as well as the safety of mounting and dismounting. Smoothness and fluidity is achieved by using straps and belts to completely replace the roller chain and sprocket or planetary gear arrangements used in prior art devices. This reduces lash and roughness caused by the clearance or play between the sprocket teeth and chains or gears previously used. Additional smoothness is produced by the multiple pulley and strap arrangement connecting the pedals to the drive shaft. The direct strap and belt mechanical interconnection between the pedals and flywheel, without requiring sprockets or gear arrangements, eliminates dead spots at the reach of pedal travel, particularly at the initial, uppermost pedal position that the pedals are in prior to beginning the downward power stroke. Additionally, the end of travel, where the pedals have reached their lowermost position, has a soft landing. The clock-wound return springs return the pedals upwardly to their rest position in a safe, smooth, easy motion, thereby reducing the chances of injury to a user while dismounting.

Other advantages of the present invention are that it has an aesthetically pleasing appearance. It is easy to use, and light enough so that it may be moved easily within the home. The machine of the present invention can provide work-outs arranging from gentle rehabilitive exercise for persons with special needs to extreme conditioning or aerobic work-outs for athletes. The present invention is stable in use because the mass of the operating mechanism, particularly the flywheel, is centrally located near the base, giving the machine a low center of gravity.

Other objects and advantages of the present invention will become more fully apparent and understood with reference to the following specification and to the appended drawings and claims.

BRIEF DESCRIPTION OF THE DRAWINGS

FIG. 3 is an enlarged detailed view of the area encircled at 3 in FIG. 2, with portions cut away.

FIG. 4 is a enlarged detailed view of the area encircled at 3 in a second operative position, again with parts cut away for clarity.

FIG. 5 is a fragmentary perspective view depicting the connection of the pedals into the drive system.

FIG. 6 is a cross-sectional view taken along line 6—6 in FIG. 1.

DETAILED DESCRIPTION OF THE PREFERRED EMBODIMENT

Figure 1:
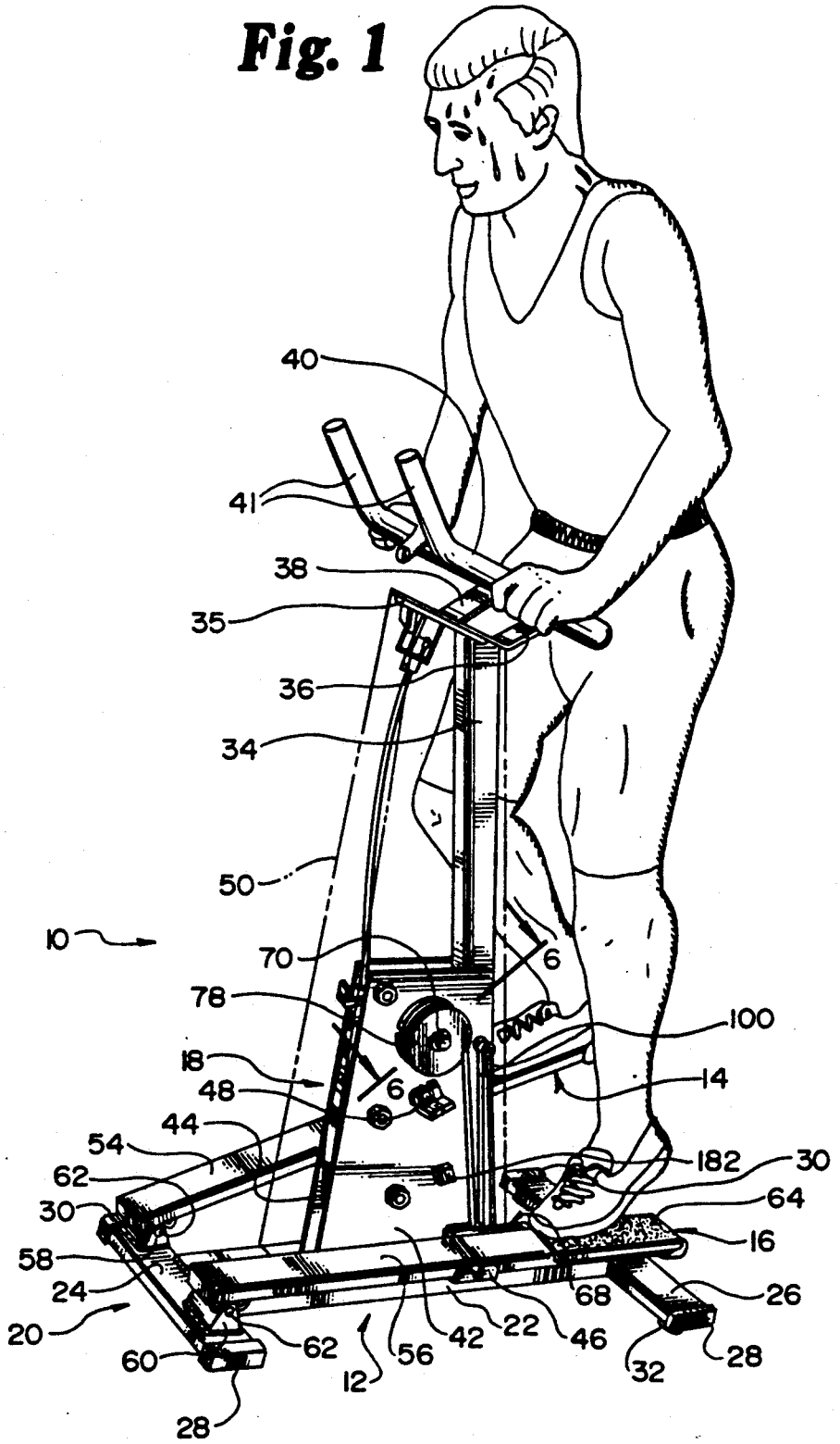
FIG. 1 is a perspective view of the exercise device of the present invention in use with the housing covers removed and depicted in phantom lines.

Referring to the drawings, particularly FIG. 1, the exercise machine 10 of the present invention for simulating stair climbing includes a frame 12, right and left foot pedals 14, 16, respectively, and a drive system, indicated generally at 18.

The generally tubular frame 12 includes a base 20 having a single central elongated member 22, a front crosstree 24, and a rear crosstree 26. The crosstrees 24, 26 are secured to the central member 22 and are generally perpendicular thereto, having lateral terminal ends 28, 30. Non-slip foot pads 32 may be secured to the underside of the crosstrees 24, 26 by appropriate means including welding or bolt and nut arrangements. A mast 34 rises generally vertically from, but at a slight angle with respect to, the central member 22. A pair of handlebar mounts 36, 38 are connected to the mast 34 at a plate 35 mounted on the end of the mast 34. A generally "U-shaped", tubular handlebar unit 40 adjacent the uppermost end of the mast 34 is secured to the handlebar mounts 36, 38.

A left cheek plate 42 and a right cheek plate 44 are connected to the frame 12 on respective sides of the mast 34. The flat cheek plates 42, 44 are spaced and substantially parallel. A stroke end cushion stop 46 is mounted to the central base member 22 and a top of stroke limit stop 48 is connected to each cheek plate 42, 44. A cover 50 is depicted in phantom.

With continued reference to FIG. 1, each pedal 14, 16 is attached to the base 12 on respective sides of the mast 34. Each pedal 14, 16 includes an associated foot pedal lever 54, 56. The forward end of each lever 54, 56 is mounted on right and left lever brackets 58, 60, in turn secured to the front crosstree 24. The levers 54, 56 are pivotally connected to the brackets 58, 60 at pivot joints 62. A non-slip foot receiving pad or surface 64 is adjacent the opposite rearward end of the levers 54, 56. A cushion 66 is attached to the underside of levers 54, 56. The cushion 66 is complementary to and received by the stroke end cushion stop 46. Each lever 54, 56 has a pin and roller channel 68 on the inside edge, or the side closest to the respective cheek plates 44, 42.

Figure 2:
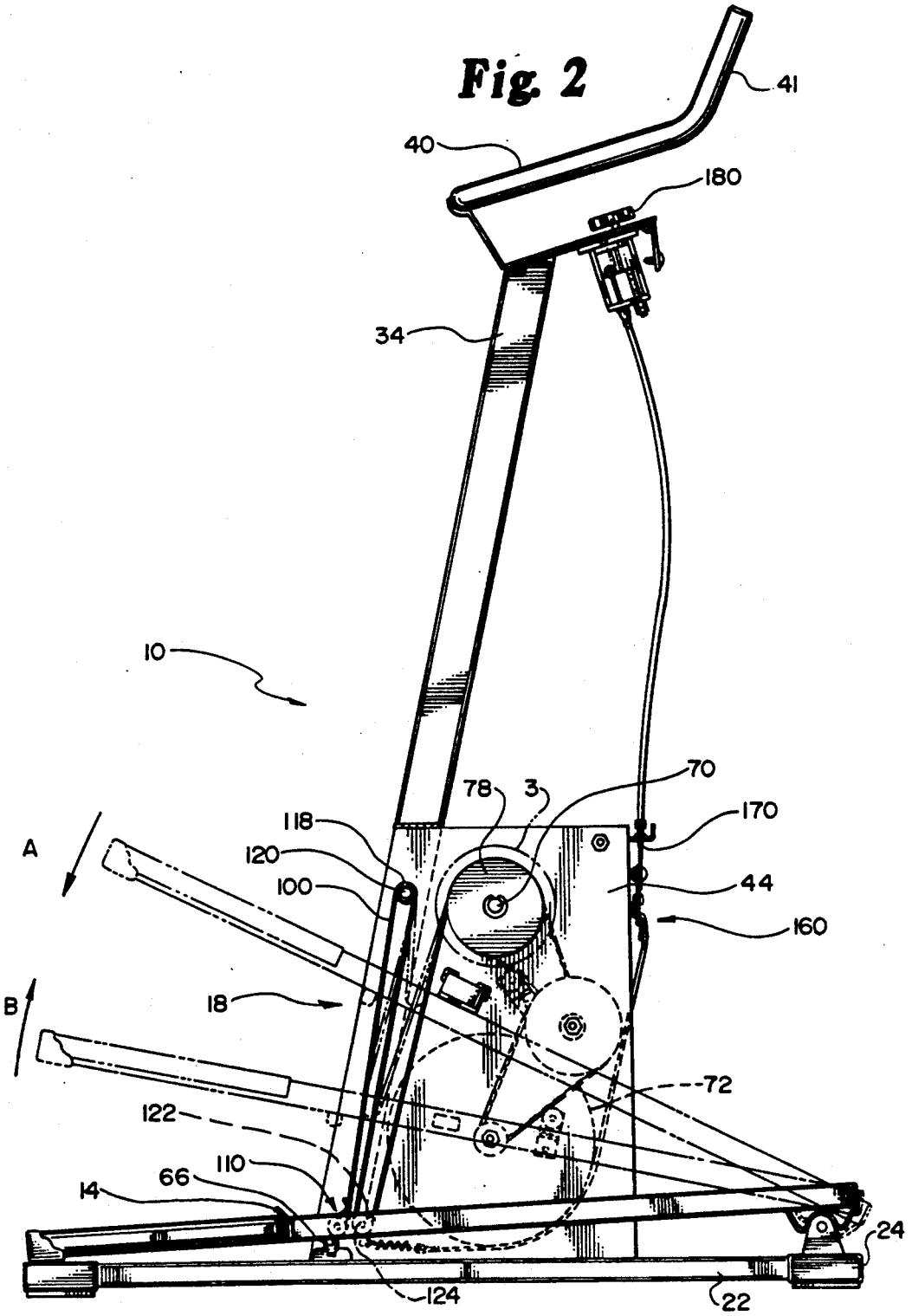
FIG. 2 is a right side elevational view of the present invention with the operative movable parts shown in selected positions of cycle.

Referring to FIG. 2, additional features of the drive system 18 of the exercise machine 10 of the present invention are depicted. The drive system 18 broadly comprises two portions, the first portion independently linking each foot pedal 14, 16 and a single, rotatable drive shaft 70, and the second portion linking the drive shaft 70 to a flywheel 72, depicted in phantom in FIG. 2.

The first portion of the drive system 18 includes independent and substantially identical right and left linkages for connecting the right and left foot pedals 14, 16 to the drive shaft 70. These linkages include the right and left clutch and rewind assemblies 74, 76 depicted in FIG. 7. Each assembly 74, 76 is substantially identical and, therefore, only the left assembly 76 will be described. The clutch and rewind assembly 76 includes a hollow spool 78 with a central cylindrical hub 80. The spool 78 is mounted on the drive shaft 70 on a typical one-way clutch 82 received in the hub sleeve 84. The spool 78 is rotatable in both of the two possible directions around the one-way clutch 82, while the drive shaft 70 is driven in only one direction because of the engagement and disengagement of the one-way clutch. The spool 78, shaft 70, and one-way clutch 82 rotate together in one direction inside ball bearings 86 and are supported relative thereto by a hub sleeve flange 88 and a bearing retainer plate 90, both connected to the left cheek plates 42 by typical bolt and nut fasteners 92. The clutch and rewind assembly 76 is held in place on the shaft 70 by a snap ring groove 94 that receives a snap keeper 96. An elongated fabric-like belt or strap 100 is wound about the outer diameter of the spool 78 between the spool flanges 102, 104. The strap 100 has a first terminal end 106 operably coupled to the spool 78. The second end 108 of the strap 100 is connected to the foot lever 56, more specifically, to the pin roller channel 68 thereof, depicted in FIG. 5.

Referring to FIG. 2, the first portion of the drive system 18 is operably connected between the respective foot pedals 14, 16 and the drive shaft 70. More specifically, referring to FIG. 5, the second, pedal lever end 108 of the strap 100 is coupled to the pin and roller channel 68 at a terminal roller assembly 110, including a terminal pin 112, washer 114 and snap ring 116. Referring to FIG. 2, the strap 100 extends generally upwardly and is received about a primary roller sheave 118 supported by the mast 34 on an axle 120. The strap 100 then passes back downwardly and is received about or travels around a secondary idler sheave 122 mounted on a secondary pin 124, and held in place by a snap ring arrangement 126. As depicted in FIG. 5, the secondary idler sheave 122 is immediately adjacent the terminal roller 110 as part of the pin and roller channel 68 on the inside of the respective foot pedals 14, 16. After passing around the secondary idler sheave 122, the strap 100 is connected at its opposite end 106 to the spool 78.

FIGS. 3 and 4 depict additional detail regarding the right and left spools 78 and the operation of the one-way clutches 82. FIG. 4 depicts the power stroke or downward stroke of the pedal in the direction of arrow A in FIG. 2. The power stroke unrolls the strap 100 in the direction of arrow A', as depicted in FIG. 4. Because the strap 100 is connected to the spool 78 at the strap end 106, the strap 100 unwinds and the spool 78 turns in a counterclockwise direction, rotating the drive shaft 70 in the same direction.

At the same time, the rotation of the spool 78 winds the clock-wound return spring 130 into increasing tension. The hook end 132 of the spring mount 130 is coupled to a spring hub 134, part of the hub sleeve 84. The opposite hook end 136 of the spring is connected to the spool 78 at a terminal notch 138. FIG. 4 depicts the power stroke almost complete (i.e., the pedal 14, 16 almost at the downward reach) with the strap 100 nearly fully unwound from the spool 78 and the clockwound spring 130 almost at maximum tension about the hub 80.

Referring to FIG. 3, the work stored in the spring 130 causes the retraction or rewinding of the strap 100 in the direction of arrow B', thereby pulling the pedal 14 upwardly, in the direction of arrow B, as depicted in FIG. 2. The difference between FIG. 3 and 4 should be clear: in FIG. 4, the one-way clutch 82 is locked on the drive shaft 70 to communicate to the shaft 70 the counterclockwise rotation of the spool 78 as the strap 100 is being unwound; whereas, in FIG. 3, the one-way clutch 82 is freewheeling. The drive shaft 70 continues to rotate counterclockwise, while the spool 78 is turning clockwise under the influence of the spring 130, thereby rewinding the strap 100 and bringing the respective foot pedal 14, 16 into its uppermost rest position, depicted in phantom in FIG. 2. FIG. 2 depicts the positions of the right foot pedal 14 as it moves through the cycle between the lowermost position and the uppermost or at rest position. Likewise, the associated sheaves 110, 118, 122 supporting and guiding the strap 100 are depicted in various locations.

Figure 7:
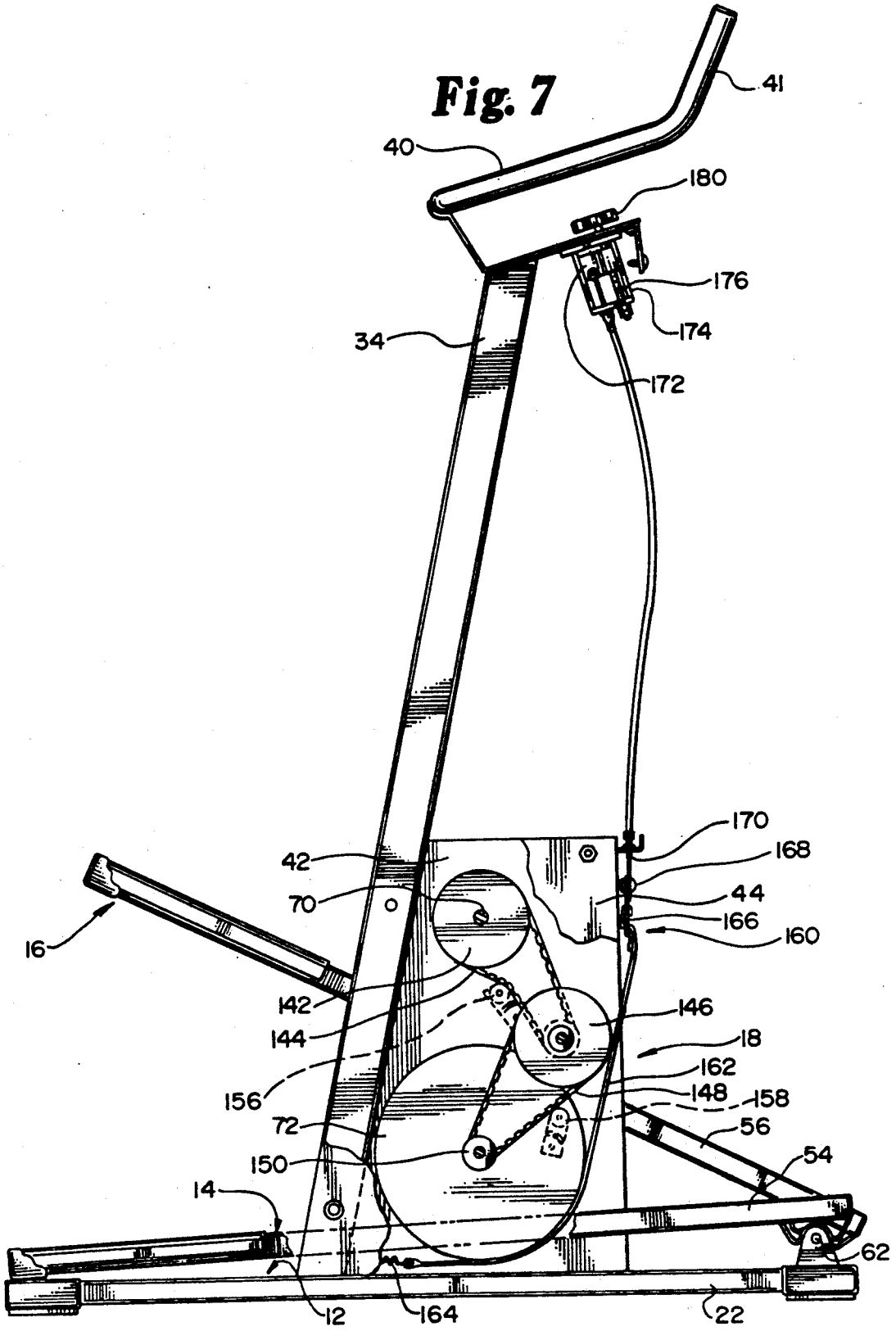
FIG. 7 is a right side elevational view of the present invention similar to FIG. 3, but with portions cut away to show the second drive portion of the drive system.

Referring to FIG. 7, the second portion of the drive system 18 is depicted. The second portion transmits the one-way rotation of the drive shaft 70 to a rotatable flywheel 72. The flywheel is designed to spin at up to approximately 3,000 rpm, with a typical exercising rpm being between 2,000–3,000 rpm. A primary positive drive sheave 142 is fixedly and generally centrally mounted on the drive shaft 70 between the clutch and rewind assemblies 74, 76. A first endless, power transmitting timing belt 144 couples the first primary drive sheave 142 to an intermediate compound idler sheave 146. A second power transmitting timing belt 148 extends between the intermediate sheave 146 to a final sheave 150. The final sheave 150 is fixedly mounted on the flywheel axle 152, as is the flywheel 72. The sheaves 142, 146, 150 and flywheel 72 are all generally coplanar in a generally vertical plane between the right and left cheek plates 44, 42. A pair of adjustable tension rollers 156, 158 are provided to adjust tension of the power transmitting belts 144, 148 as necessary.

With continued reference to FIG. 7, the resistance adjustment mechanism 160 of the present invention is depicted. A brake band 162 is attached at one end to a brake tension spring 164, in turn connected to the frame 12 of the machine 10. The second opposite end of the brake band 162 is coupled to a cable to band conversion fitting 166. A cable clamp 168 connects the brake cable 170 to the brake band 162. The opposite end of the cable 170 is coupled to a brake block 172, movably received in a brake housing 174. The brake block 172 is threadably received on an adjustment screw 176 operated by a knob 180. The knob 180 may be turned clockwise to tighten the cable 170, thereby tightening the brake band 162 about the flywheel 72 and increasing the difficulty of the exercise workout.

In use, to exercise on the machine 10 of the present invention, the exerciser may grasp the handlebars 40 or hand grips 41, and step onto both of the right and left foot pedals 14, 16. The pedals 14, 16 will be in the uppermost rest position, brought there by the clockwound springs 130 of the right and left clutch and rewind assemblies 74, 76. Under the weight of the exerciser or a force exerted by the exerciser, the pedals will move downwardly to their lowermost position. The left pedal 16 is depicted in this position in FIG. 1. The exerciser begins exercising by transferring weight or exerting pressure onto one of the foot pedals. At the same time, because there is no weight on it, the other pedal will be drawn upwardly by the spring-drawn strap 100. The exerciser continues to exercise by alternately raising the body's weight with the right and left legs and may adjust the length and rate of stride to a comfortable level.

It should be appreciated that the drive system 18 is located closely adjacent to and primarily between the right and left cheek plates 44, 42 and low or relatively close to the base 12. Thus, an advantage of the exercise machine 10 of the present invention is that it is very stable, having a low center of gravity, even when significant forces are exerted on the handlebars 40 while exercising. Another advantage of the drive system 18 is that it has a gear ratio of approximately 25 to 35:1. This enables an appropriate resistance and level of exercise and promotes a smooth, relatively easy initial down stroke at the start of exercise. The drive system 18 also enables a soft-landing at the lowermost pedal position and a gradual slow down or free-wheeling of the second drive portion, including the flywheel 72, back to the one-way clutches 82 on the drive shaft 70.

The first and second power belts 144, 148 provide some significant advantages. The belts 144, 148 are economical, they do not require absolutely parallel shafts or perfectly aligned sheaves, and are less likely to overload and jam than prior art roller chain and sprocket arrangements. The belts 144, 148 significantly reduce noise and vibration, and the life of the sheaves 142, 146, 150 is prolonged because load fluctuations are cushioned, that is, the belts 144, 148 tend to absorb shock. Additionally, they are lubrication free and require low maintenance. The two belts 144, 148 are of the type commonly known as "timing" belts, having evenly spaced raised portions which mesh with grooves cut on the periphery of the sheaves or pulleys to produce positive, no slip, constant speed drive. This type of belt requires less tension than other belt types and is among the most efficient. The belts 144, 148 may be formed from various materials including reinforced or nonreinforced rubber, plastic, and/or fabric.

Other advantages of the present invention are that the exerciser may slow the pace of exercise gradually, allowing for a "warm-down" period following periods of more intense exercise. Once the exerciser has finished the workout, he or she may simply stand still on the pedals which will sink slowly and gradually to the lowermost position under the weight of the exerciser. Upon stepping off from the machine, the pedals will return smoothly and gently to the uppermost position of rest, whereupon they are ready for another exerciser or exercise session. Referring to FIG. 1, a step or stroke counter 182, either mechanical, electro-mechanical or electro-optical, may be provided to count the steps made by an exerciser and to determine the amount of exercise obtained.

The present invention can be changed by modifying the shape of the housing cover 50 or pedal levers 54, 56 and additional housing members might be used to cover the base. Instead of a generally "U-shaped" handlebar 40 with hand grip ends 41, a single, generally tubular, substantially rectangular closed plane figure handlebar 40 continuous with the frame 12 might be used. Additionally, the handlebar 40 may be wrapped with various appropriate materials including sponge or tape. The exercise machine 10 might be provided with indicia, labeling or instructions as deemed appropriate. The device 10 of the present invention optionally might include an electronic sensing, calculating and display system for determining and showing the amount of work an exerciser has done.

Although a description of the preferred embodiment has been presented, it is contemplated that various changes, including those mentioned above, could be made without deviating from the spirit of the present invention. It is desired, therefore, that the present invention be considered in all respects as illustrative, not restrictive, and that reference be made to the appended claims rather than to the foregoing description to indicate the scope of the invention.

What is claimed and desired to be protected by letters patent is:

1. An exercise machine for simulating stair climbing, said machine comprising:

a frame;

movable, foot-receiving right and left pedals coupled to said frame;

rotatable inertial resistance means coupled to said frame; and a drive system operatively coupling said pedals to said inertial resistance means, wherein said drive system comprises a first drive portion including a single rotatable drive shaft and two independent linkages, a right drive linkage and a left drive linkage, operatively linking each the respective pedal to said drive shaft and including at least two runs extending in generally opposite directions, each said linkage including lengthening means for lengthening said linkage whereby the movement of said pedals is transferred smoothly to said drive shaft, and a second drive portion that transmits the rotation of said drive shaft to said resistance means, said second drive portion comprising a first primary drive sheave mounted on said drive shaft, an intermediate transfer sheave, an endless power belt transmission means for connecting said primary and intermediate sheaves, a final sheave co-axially mounted with said resistance means, and a second endless power belt transmission means for connecting said intermediate and final sheaves.

2. An exercise machine that simulates climbing stairs to provide exercise for a user, said machine having a frame, right and left foot pedals, each pedal movable from an upper to a lower position as the user applies force thereto and from a lower to an upper position as the force is removed therefrom, a rotatable flywheel supported by said frame, and a drive means for transmitting said force to said flywheel, said drive means comprising:

a first drive portion including independent right and left drive linkages linking the respective pedal to a single rotatable drive shaft, said right and left linkages each including a spool operably coupled to said drive shaft and a web means for connecting said respective pedal to said spool, each web means having a first end connected to said respective pedal, a second end connected to said spool, and an intermediate portion including at least two generally parallel runs adapted for movement in generally opposite directions; and a second drive portion including a first drive sheave mounted on said drive shaft, an intermediate transfer sheave, a final sheave, a first endless belt means for coupling said first and intermediate transfer sheaves, and a second endless belt means for coupling said intermediate transfer and final sheaves, whereby the rotation of said drive shaft is transmitted to said flywheel.

3. The exercise machine according to claim 1, wherein said endless power transmission means are timing belts.

4. The exercise machine according to claim 2, wherein each said linkage includes at least one intermediate idler means for adapting said web means to include said at least two generally parallel runs movable in opposite directions with respect to each other.

5. The exercise machine according to claim 2, wherein each of said linkages includes two idler means for creating said at least two generally parallel runs of said web means, one of said idler means being fixed and the second of said idler means being movable.

6. The exercise machine according to claim 5, wherein each said fixed idler means is operably mounted to said frame, and each said movable idler means is operably mounted on the respective pedal.

7. The exercise machine according to claim 6, wherein the idler means operably mounted on the pedals is closely adjacent to said first end of said web.

8. The exercise machine according to claim 7, wherein said machine includes a friction brake member contacting a selectively variable portion of the flywheel with more or less force, thereby increasing or diminishing the resistance to motion of the flywheel.

9. An exercise machine for simulating stair climbing, said machine comprising:

a frame;

movable, foot-receiving right and left pedals coupled to said frame;

a flywheel coupled to said frame; and a drive system operatively coupling said pedals to said flywheel and comprising:

a drive shaft rotatably supported by the frame, said drive shaft being rotatable in one direction;

substantially similar independent right and left drive linkages, each linking the associated right and left pedal to said drive shaft, whereby the movement of the pedals is transferred to said drive shaft, each linkage including a rewind assembly mounted on said drive shaft and a continuous linking means for linking said rewind assembly and the associated pedal, said linking means having a first end connected to the rewind assembly, a second end connected to the associated pedal, and an intermediate portion including at least two closely adjacent generally parallel runs adapted to move in opposite directions relative to each other when the associated pedal is moved, said generally parallel runs being received at each end thereof by independent idler means for receiving said linking means;

a primary drive sheave fixedly mounted on said drive shaft between said rewind assemblies;

an intermediate compound transfer sheave;

a final driven sheave co-axially mounted with said flywheel; and two endless connecting means, a first said connecting means for connecting said primary and intermediate sheaves, and the second of said connecting means for connecting said intermediate and final sheaves.

10. The exercise machine according to claim 9, wherein each independent idler means of each linkage includes a fixed idler means being fixed to said frame and a movable idler means being fixed to the associated pedal.

11. The exercise machine according to claim 9, wherein said linking means comprises a strap and each said rewind assembly comprises a one-way clutch mounted on said drive shaft, a hollow spool mounted on said one-way clutch, and a clockwound spring received in said spool.

12. The exercise machine according to claim 9 and a brake band adjustably contacting a portion of the outer circumference of the flywheel.

13. The exercise machine according to claim 9 and an electronic sensing, calculating and display means for sensing, calculating and displaying the amount of exercise an exerciser has done.

14. An exercise machine for simulating stair climbing, said machine comprising:

a frame;

movable, foot-receiving right and left pedals coupled to said frame;

a flywheel coupled to said frame; and a drive system operatively coupling said pedals to said flywheel, said drive system comprising:

a drive shaft rotatably supported by the frame, said drive shaft being rotatable in one direction;

substantially similar independent right and left drive linkages, each linking the associated right and left pedal to said drive shaft, whereby the movement of the pedals is transferred to said drive shaft, each linkage including a spool and rewind assembly mounted on said drive shaft and a continuous fabric-like strap having a first end connected to the spool and rewind assembly, a second end connected to the associated pedal, and an intermediate portion including at least two closely adjacent generally parallel runs adapted to move in opposite directions relative to each other when the associated pedal is moved, said generally parallel runs being received at each end thereof by an independent idler roller, one of said idler rollers being fixed to said frame and the other being fixed to the associated pedal;

a primary drive sheave fixedly mounted on said drive shaft between said spool and rewind assemblies;

an intermediate compound transfer sheave;

a final driven sheave co-axially mounted with said flywheel; and two endless timing belts, one of said timing belts connecting said primary and intermediate sheaves, and the second of said timing belts connecting said intermediate and final sheaves.

15. The exercise machine according to claim 14, wherein each said spool and rewind assembly comprises a one-way clutch mounted on said drive shaft, a hollow spool mounted on said one-way clutch, and a clockwound spring received in said spool.

16. The exercise machine according to claim 15, wherein said primary drive sheave, intermediate compound sheave, and final drive sheave are substantially coplanar and step-wise provide that the flywheel rotates faster than the drive shaft.

17. The exercise machine according to claim 16 and an electronic sensing, calculating and display means for sensing, calculating and displaying the amount of exercise an exerciser has done.

18. The exercise machine according to claim 17 and a brake band adjustably contacting a portion of the outer circumference of the flywheel.

* * * * *